United States Patent [19]

Benson et al.

[11] Patent Number: 4,972,058

[45] Date of Patent: Nov. 20, 1990

[54] SURFACE HEATING FOOD WRAP WITH VARIABLE MICROWAVE TRANSMISSION

[75] Inventors: Kenneth A. Benson, Chatham, Pa.; Dan S. C. Fong, Wilmington, Del.

[73] Assignee: E. I. Du Pont de Nemours and Company, Wilmington, Del.

[21] Appl. No.: 447,392

[22] Filed: Dec. 7, 1989

[51] Int. Cl.[5] ..... H05B 6/80

[52] U.S. Cl. ..... 219/10.55 E; 219/10.55 F; 426/107; 426/234; 426/243; 99/DIG. 14; 126/390; 428/35.3; 428/35.8

[58] Field of Search ..... 219/10.55 E, 10.55 F, 219/10.55 R; 426/107, 109, 113, 241, 243, 234; 99/451, DIG. 14; 126/390; 428/34.2, 34.5, 35.3, 35.8, 36.3

[56] References Cited

U.S. PATENT DOCUMENTS

| | | | |
|---|---|---|---|
| 3,271,169 | 9/1966 | Baker | 99/221 |
| 3,302,632 | 2/1968 | Fichtner | 219/10.55 E |
| 3,547,661 | 12/1970 | Stevenson | 99/171 |
| 4,190,757 | 2/1980 | Turpin | 219/10.55 E |
| 4,267,420 | 5/1981 | Brastad | 219/10.55 E |
| 4,434,197 | 2/1984 | Petriello et al. | 219/10.55 E |
| 4,518,651 | 5/1985 | Wolfe | 219/10.55 E |
| 4,656,325 | 4/1987 | Keefer | 219/10.55 E |
| 4,735,513 | 4/1988 | Watkins | 426/113 |
| 4,806,718 | 2/1989 | Seaborne et al. | 219/10.55 E |
| 4,851,632 | 7/1989 | Kaliski | 219/10.55 E |
| 4,876,423 | 10/1989 | Tighe et al. | 219/10.55 E |
| 4,911,938 | 3/1990 | Fisher et al. | 426/107 |

FOREIGN PATENT DOCUMENTS

| | | |
|---|---|---|
| 0242952 | 10/1987 | European Pat. Off. . |
| 206811 | 10/1988 | European Pat. Off. . |

*Primary Examiner*—Philip H. Leung

[57] ABSTRACT

The present invention provides a composite material for generation of heat by absorption of microwave energy comprising a porous dielectric substrate and a coating comprising a thermoplastic dielectric matrix and flakes of a micorwave susceptive material distributed within the matrix, said flakes having an aspect ratio of at least about 10, a generally planar, plate-like shape, with a thickness of about 0.1 to about 1.0 micrometers, a transverse dimension of about 1 to about 50 micrometers, and angular edges. The composite material exhibits decreased microwave transmission as a function of previously applied pressure.

31 Claims, 4 Drawing Sheets

SURFACE HEATING FOOD WRAP WITH VARIABLE MICROWAVE TRANSMISSION

BACKGROUND OF THE INVENTION

This invention relates to packaging material for heating or cooking of food by microwave energy. It is particularly directed to microwave active film or wrapping materials which provide a level of heating which can be varied to match the heating requirements of a variety of foods.

A wide range of prepackaged refrigerated or frozen foods has long been commercially available. Such foods may be heated in conventional gas or electric ovens, or more recently in microwave ovens. However, suitable packaging of multi-component meals for microwave cooking has been an elusive goal. Different foods respond to microwave energy in different ways, depending on their physical and electrical properties, mass, shape, and other parameters. Different foods also require different amounts of heating in order to reach a suitable, customary serving temperature. For example a fruit dish may require defrosting but little or no heating above room temperature. A meat entree should be heated to about 100° C. Vegetables should likewise be heated to near 100° C., but care should be taken that they do not become overcooked or dry. Bread products should have a hot, crisp crust and an interior that is not overheated or dried out.

There has been a long-felt need for a practical microwave packaging material that can be readily adapted to the heating and cooking requirements of a variety of diverse foods. Many attempts have been made to achieve this result by indirect means, such as by providing shielding of food components or by selective spacing of foods within a package. For example, U.S. Pat. No. 3,219,460, Brown, teaches heating of two or more frozen food items using a multi-compartment electrically conductive tray, each compartment being shielded with a top made of an electrically conductive material with several openings to regulate access to high frequency waves.

U.S. Pat. No. 3,271,169, Baker, discloses varying food spacing from an underlying conductive layer or ground plane. Dielectric spacers may be employed, the food products may be located on various heights above a conductive sheet, or the conductive sheet may be at different distances below the different foodstuffs.

U.S. Pat. No. 3,302,632, Fichtner, discloses the uniform cooking of different foods by providing a cooking utensil the walls of which regulate microwave transmission to the food. High conductivity grids of different mesh are used to dampen the microwaves.

U.S. Pat. No. 4,190,757, Turpin, discloses a package which includes a metal foil shield having holes of a selected size to provide a predetermined controlled amount of direct microwave energy to the food.

U.S. Pat. No. 4,656,325, Keefer, discloses a pan with a cover which is said not to transmit refected microwave energy. The cover can be comprised of a dielectric substrate having metal powder or flakes dispersed therein and can bear an array of conductors comprising a plurality of spaced-apart, electrically conductive islands.

U.S. Pat. No. 3,547,661 Stevenson, discloses a container for heating different items to different temperatures simultaneously comprising a cover of a radiation reflecting material having apertures in opposite walls formed in the material. Food items are selectively placed in or out of alignment with the apertures.

European Patent Application 206 811, Keefer, discloses a container for heating material in a microwave oven, comprising a metal foil tray with two rectangular apertures. The container lid is a microwave transparent material having two metallic plates located thereon, in registry with the apertures.

Various types of films or sheets have been disclosed which are useful as lids or wraps for microwave cooking. For example, U.S. Pat. No. 4,518,651, Wolfe, discloses a flexible composite material which exhibits a controlled absorption of microwave energy based on presence of particulate carbon in a polymeric matrix bound to a porous substrate. The coating is pressed into the porous substrate using specified temperatures, pressures, and times, resulting in improved heating.

U.S. Pat. No. 4,735,513, Watkins, discloses a flexible sheet structure comprising a base sheet having a microwave coupling layer and a fibrous backing sheet such as paper bonded thereto to provide dimensional stability and prevent warping, shriveling, melting or other damage during microwave heating.

European application 0 242 952 discloses a composite material for controlled generation of heat by absorption of microwave energy. A dielectric substrate, e.g., PET film, is coated with a metal in flake form, in a thermoplastic dielectric matrix. The use of circular flakes with flat surfaces and smooth edges is preferred. Flakes of aluminum are disclosed.

U.S. Pat. No. 4,267,420, Brastad, discloses a plastic film or other dielectric substrate having a very thin coating thereon which controls the microwave conductivity when a package wrapped with such film is placed within a microwave oven.

SUMMARY OF THE INVENTION

The present invention provides an economical, versatile, and easy to prepare composite material suitable for selectively absorbing and shielding microwave energy, and thereby selectively heating foods in a microwave oven. In particular, the present invention provides a composite material for shielding and generation of heat in microwave cooking of food packages by selected absorption and shielding of microwave energy, comprising:

(a) at least one porous dielectric substrate substantially transparent to microwave energy;

(b) at least one coating on at least a portion of the substrate, comprising:

(i) a thermoplastic dielectric matrix;

(ii) flakes of a microwave susceptive material distributed within the matrix, said flakes having on average an aspect ratio of at least about 10, a generally planar, plate-like shape, with a thickness of about 0.1 to about 1.0 micrometers, a transverse dimension of about 1 to about 50 micrometers, and a predominantly jagged outline, said flakes being present in a concentration sufficient to heat food products in proximity thereto upon exposure to radiation of a microwave oven;

said composite material exhibiting decreased microwave transmission as a function of previously applied pressure.

The present invention further provides a process for preparing such a film, comprising:

(a) providing a porous dielectric substrate substantially transparent to microwave radiation;

(b) applying to the substrate a coating of a thermoplastic dielectric matrix with a dispersion of flakes of a microwave susceptive material distributed therein, said flakes having on average an aspect ratio of at least about 10, a generally planar, plate-like shape, with a thickness of about 0.1 to about 1.0 micrometers, a transverse dimension of about 1 to about 50 micrometers, and a predominantly jagged outline, said flakes being present in a concentration sufficient to heat food products in proximity thereto upon exposure to radiation of a microwave oven;

(c) heating the coating to a temperature above the softening point of the matrix; and (d) pressing at least a portion of the heated coating against the substrate at a pressure of at least about 0.3 MPa for at least about 0.03 seconds; and (e) cooling below the softening point before releasing the pressure, whereby the transmission of microwave energy through the portion of the coating so pressed is thereafter reduced.

DETAILED DESCRIPTION OF THE INVENTION

The present invention consists of a porous substrate which is coated with microwave susceptive material as will be later described. The porous substrate is a dielectric material which is substantially transparent to microwave radiation, and which is of sufficient thermal stability for use in a microwave oven. The porous substrate is a sheet or web material, usually paper or paperboard. If the substrate is paper or paperboard, the side which receives the microwave active coating, described later, must not be otherwise coated or, if coated, the coating must be porous nevertheless. An acceptable paper coating is usually clay or sizing or some decorative ink or lacquer which may reduce the porosity of the substrate but not eliminate it altogether. Other porous dielectric materials can be used as substrates as long as they maintain sufficient rigidity and an adequate thermal and dimensional stability at temperatures up to about 250° C. or higher, as would be encountered in a microwave oven. Besides paper and paperboard, paper towels and cloth can also be effectively used.

The porous dielectric substrate is coated with metal flakes contained in a thermoplastic matrix polymer. The matrix polymer can be any of a variety of polymeric materials such as polyesters, polyester copolymer, ethylene copolymer, polyvinyl alcohol, polyamide, and the like. Polyester copolymers are preferred. Particularly preferred polyester copolymers include those prepared from ethylene glycol, terephthalic acid, and azelaic acid; copolymers of ethylene glycol, terephthalic acid, and isophthalic acid; and mixtures of these copolymers. Preferably the matrix is a copolymer prepared by the condensation of ethylene glycol with terephthalic acid and azelaic acid, the acids being in the mole ratio of about 50:50 to about 55:45.

Figure 1:
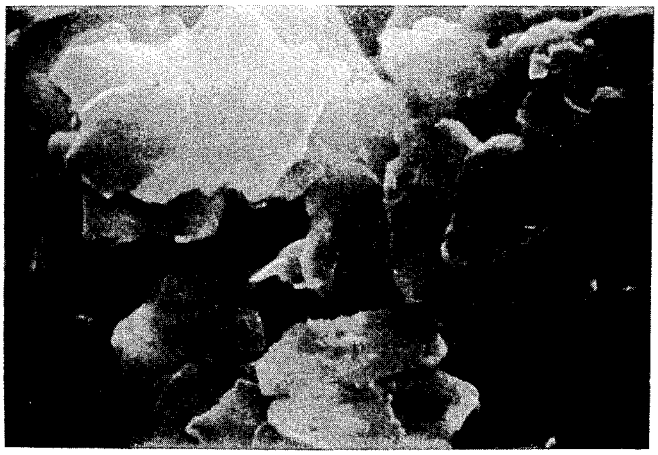
FIG. 1 is a photomicrograph of conductive flakes suitable for use in the present invention.
Figure 2:
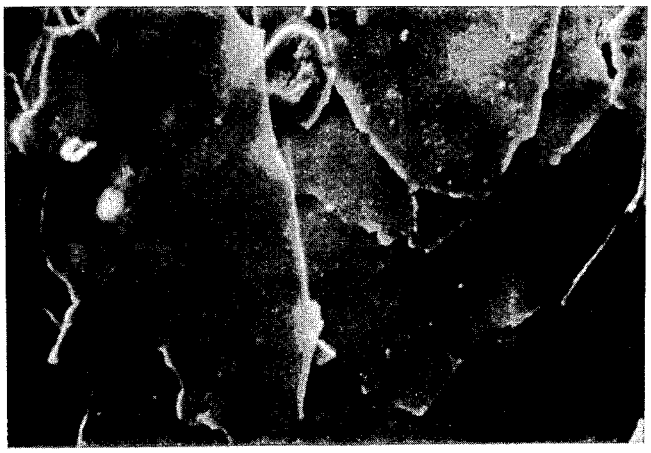
FIG. 2 is a photomicrograph of additional flakes suitable for use in the present invention.
Figure 3:
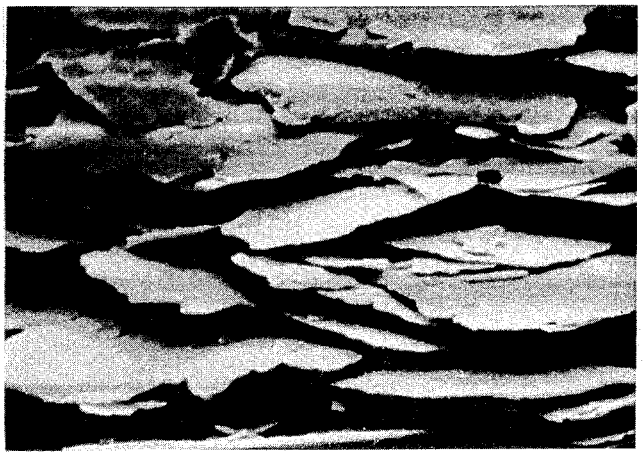
FIG. 3 is a photomicrograph of yet additional flakes suitable for use in the present invention.
Figure 4:
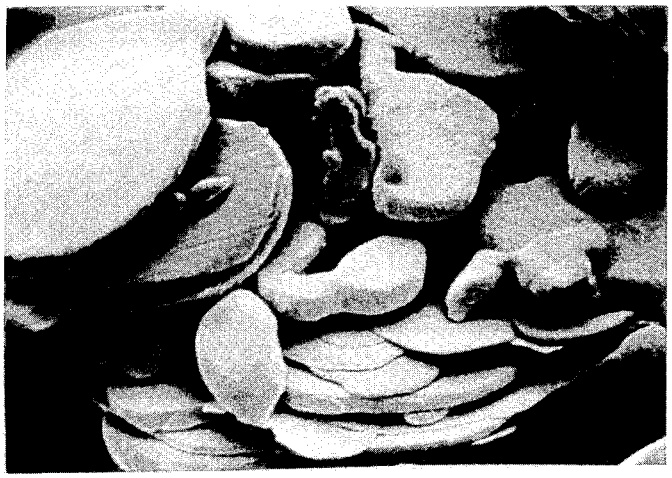
FIG. 4 is a photomicrograph of flakes generally unsuitable for the present invention.
Figure 5:
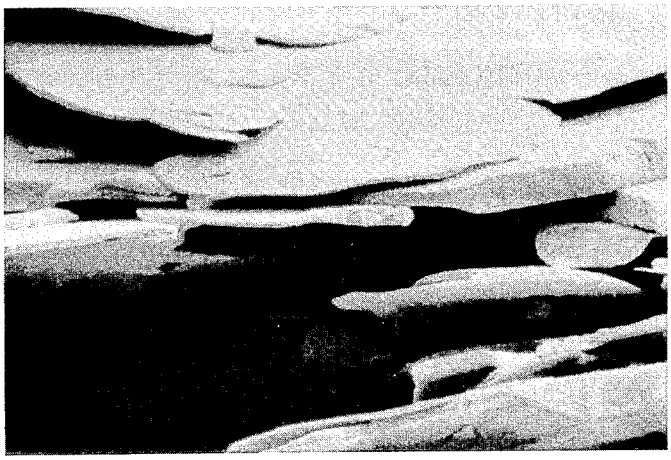
FIG. 5 is a photomicrograph of additional flakes generally unsuitable for the present invention.

The metal flakes suited for this invention may be prepared from any elemental metal or alloy which is not particularly toxic or otherwise unsuited for use in connection with the desired packaging application. Examples of suitable metals include aluminum, nickel, antimony, copper, molybdenum, iron, chromium, tin, zinc, silver, gold, and various alloys of these metals e.g. stainless steel; the preferred metal is aluminum. The flakes should have a particular size and geometry in order for the advantages of the present invention to be fully realized. The flakes are generally planar and plate-like, and should have on average an aspect ratio of at least about 10, preferably at least about 40, a thickness of about 0.1 to about 1.0 micrometers, preferably about 0.1 to about 0.5 micrometers and a diameter or transverse measurement of about 1 to about 50 micrometers, preferably about 4 to about 30 micrometers. Finally, the flakes should have a predominantly jagged perimeter. Suitable flakes are shown in FIGS. 1, 2, and 3. In contrast FIGS. 4 and 5 illustrate flakes which are generally unsuited to the present invention. (Each of the photomicrographs shows metallic aluminum flakes at a magnification of about 3,000× and made by scanning electron microscopy.)

Figure 6:
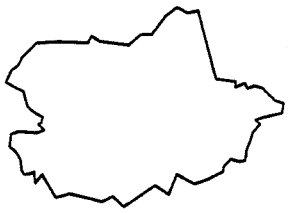
FIGS. 6 and 7 are schematic drawings showing the contours of flakes suitable for the present invention.
Figure 7:
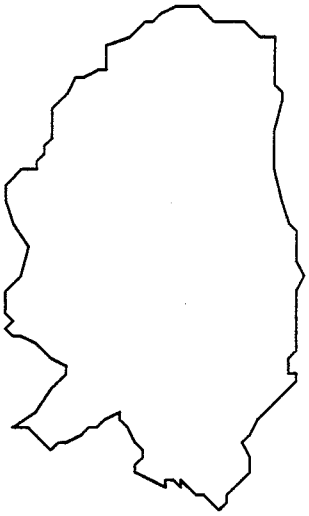
Figure 8:
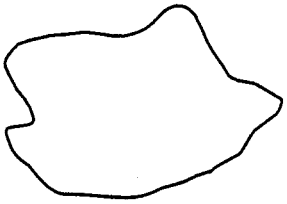
FIGS. 8 and 9 are schematic drawings showing, for comparison, smooth curves defining the plate-like shapes of FIGS. 6 and 7.
Figure 9:
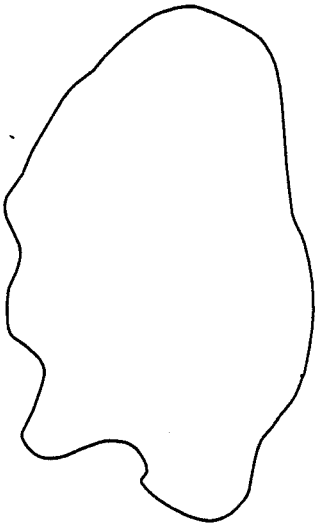

Although no satisfying theoretical explanation has been proposed for the difference in properties of the acceptable versus the unacceptable flakes, acceptable properties are empirically associated with a flake shape having predominantly jagged or angular edges, rather than predominantly smooth or rounded edges. The angular perimeter may be described as arising from a multiplicity of substantially straight lines intersecting at points to form angles of substantially less than 180°. The resulting geometric figure has a perimeter in excess of that of a smooth curve defining the same plate-like shape. For example, FIG. 8 is a smooth curve defining the shape of the flake outlined in FIG. 6. Likewise FIG. 9 corresponds to FIG. 7. It is clear that the angular or jagged perimeter has a greater length than the smooth, curved perimeter.

It is recognized that the apparent smoothness or angularity of the outline of a flake may depend to some extent on the magnification used to view the flake. Thus the flakes of FIG. 4, if much more highly magnified, might show jagged or irregular features. Or the flakes of FIG. 1, if more highly magnified, might show smaller scale rounded or smooth features at the apparently angular points. But any jagged features in the flakes of FIGS. 3 or 4 would appear only on a scale comparable to or smaller than the thickness of the flakes. The jagged features of the desired flakes (i.e., lengths of the defining line segments), however, are generally of a size and on a scale greater than the thickness of the flake itself, so that the flake has a jagged appearance. Of course, it is also possible that a certain fraction of predominantly smooth flakes may show some jagged features, due, e.g., to breakage during handling. This is not what is intended by the term "predominantly jagged." It is rather the predominant jagged character of the bulk of the flakes that is characteristic of the present invention.

An example of suitable flakes is "Reynolds LSB-548," obtainable from Reynolds Aluminum Company, Louisville, KY. It is believed that such flakes are made by a process which involves extensive milling, perhaps resulting in fracture of the flakes. In contrast, the more rounded flakes of FIG. 3 are believed to be made by a less extensive rolling or milling process. Other, thinner, jagged flakes are believed to be made by vacuum deposition onto a substrate followed by removal with consequent cracking and fracturing.

The concentration of the flakes in the final matrix should be sufficient to provide a measurable amount of interaction with or shielding of incident microwave energy. Preferably the concentration is sufficient to provide a usable amount of heat when exposed to microwave energy. A particularly useful amount of heat is that required to heat to raise the temperature of the film to at least about 150 C, more preferably to about 190° C., and to provide sufficient heat flux for browning or crispening of adjacent food items. For example, the coating can comprise about 5 to about 80% by weight of flake in about 95 to about 20% by weight of the thermoplastic matrix polymer. Preferably the relative amount of the flake material will be about 25 to about 80%, and most preferably about 30 to about 60%. A total coating thickness of about 10 to about 250 micrometers is suitable for many applications. The surface weight of such a coating on the substrate is about 2.5 to about 100 $g/m^2$, preferably about 5 to about 85 $g/m^2$, corresponding to a surface concentration of metal flakes of about 1 to about 50 $g/m^2$, preferably about 2 to about 25 $g/m^2$.

The films of the present invention are made by preparing a mixture of the metal flake in a melt, a solution, or a slurry of the matrix polymer, and applying the coating onto the porous substrate. This coating can be applied by means of doctor knife coating, metered doctor roll coating, gravure roll coating, reverse roll coating, slot die coating, and so on. The coating may be applied to the entire surface area of the porous substrate or to selected areas only. For example, it may be convenient to apply the susceptor material as a stripe of an appropriate width down the middle of a web of film, or as a patch covering a selected area. Additional layers of other materials, such as adhesives, heat sealable thermoplastics, heat-resistant plastic films, or barrier layers may be optionally added to suit the particular packaging requirements at hand, provided that such layers are not interposed between the microwave active coating and the porous substrate.

An important feature of the present invention is that the microwave active coating on the porous substrate can be subjected to pressure, to force the two components tightly together. Suitable pressures will be determined by the particular results desired, but in general pressures of at least 0.3 MPa for at least 0.03 seconds are required in order to begin to observe the benefits of the present invention. Preferably pressures of about 0.7 to about 17 MPa should be applied, and most preferably about 1.4 to about 8 MPa. Such pressures should preferably be applied for about 1 to about 200 seconds. Pressure can be applied by means of heated plattens, heated rollers, and the like. The temperature should be sufficient to soften the matrix but not to the point that melting or degradation of the matrix will occur. For the polyester copolymers of the examples which follow, a suitable temperature is about 190° C.

It has been found that the transmission of microwave energy through, and the heating effectiveness of, films of this invention depends on the extent of pressure applied, as is further illustrated in the Examples which follow. Application of increased pressure results in decreased microwave transmission. Furthermore, it is seen that the heating ability of pressed films of the present invention is improved over that of unpressed films, as determined by temperature rise or heat flux (described below). This increased heating does not correlate well with increased absorbance of microwave energy, measured as described below. The mechanisms of these phenomena are not known. In U.S. Pat. No. 4,518,651, the application of pressure was found to force some of the matrix polymer beneath the surface of the porous substrate, resulting in concentration of the microwave active material (carbon) in the remaining matrix. Such a mechanism, however, is not apparent in structures of the present invention, since no penetration of the matrix into the substrate has been observed using electron microscopy.

Figure 10:
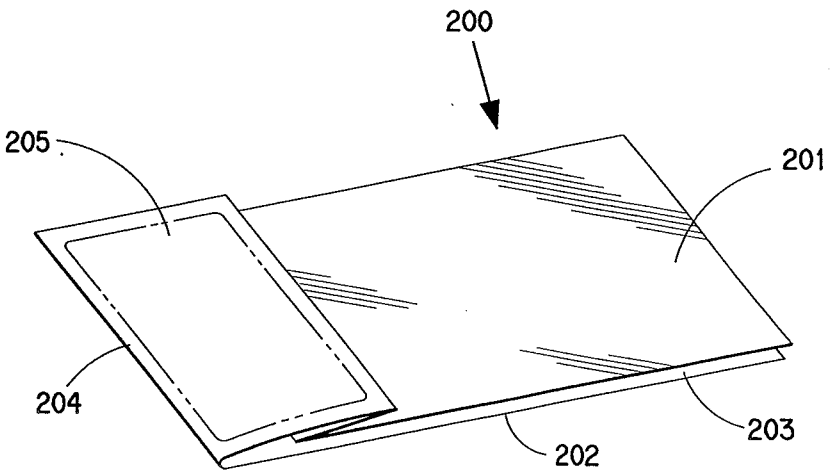
FIG. 10 shows a food package of the present invention in the form of a bag formed from the composite material of the present invention.

An important benefit of the present invention is that application of pressure provides a simple method for adjusting the microwave transmission properties of the composition of the present invention. An entire film may be pressed to a certain pressure, to produce the desired microwave properties. Or selected portions of a film can be pressed, independently, to a desired pressure. In this way a single piece of film structure can have different areas exhibiting different microwave transmission and heating properties. Such differentially pressed films can be used for packaging applications in which different food items require different amounts of microwave heating. For example, such a differentially pressed composite material can be used in cooking bags such as popcorn bags, which currently represent a major end use for microwave susceptor packaging. FIG. 10 shows such a popcorn bag. The bag, 200, can be prepared from a flexible paper, such as kraft paper or the like, suitable for holding unpopped corn. The bag has front and rear panels 201 and 202, side gussets, one of which (203) is shown, and a bottom, 204. The entire surface of the bag, preferably the inner surface, can be coated with the aluminum flake material described above, but with a level of metal coating that will not cause the material to heat above the point at which the seals holding the package together release. The coating weight to accomplish this must be determined experimentally and will differ for differing sealing coatings, flake sizes, and the like, as will be apparent to one of ordinary skill in the art. In a selected region 205 on the bottom of the bag the coating can be heat pressed as described above to a degree sufficient to raise the temperature of that region to a temperature suitable for popping the corn. This specific degree of pressing will likewise be determined by experiment. The rest of the bag will heat to a lower temperature and contribute to the popping process. The more even distribution of heat will reduce the number of unpopped kernels and minimize the scorching of kernels, yet without damaging the seals of the bag. The seals will be located away from the hot, active popping region at the bottom of the bag.

Similarly, such differentially pressed structures can be used to apply different cooking conditions to various foods in accordance with their differing cooking requirements. For example, a bread product can be placed in a package adjacent to an area of composite material which has been extensively pressed so to as to generate a great deal of surface heating but to transmit a relatively low amount of microwave energy. Simultaneously, a meat or potato food can be placed in the package adjacent to an area of composite material which has been pressed less extensively or not at all and thus transmits more of the incident microwave energy to the interior of the product. The resulting package will more uniformly cook the various food items to their proper temperatures and serving conditions.

In an alternative application, the present structures are useful in heating or cooking bread or other dough products in a microwave oven. Dough products include foods which have been previously fully baked but need reheating as well as partially baked foods and unbaked products. Each of these varieties of dough products are characterized to some degree by the need to achieve a browned and crispened crust and a warm, moist, cooked interior that is not tough. Because foods cooked in a microwave oven heat from the inside out, it is often difficult to achieve both surface browning and proper internal cooking. Foods are often cooked inside but not properly crusted, or crusted but overcooked inside. Interior overcooking of dough products is revealed by rapid hardening of the interior upon standing after cooking. A properly cooked bread product will retain a satisfactorily tender interior after removal from the microwave oven and standing to cool for five minutes. Overcooked bread products, however, are excessively hard after standing five minutes.

A suitable wrap for cooking of dough products will provide a high heat flux for surface browning and crisping and relatively low microwave transmission for slow cooking of the interior of the bread. The structures of the present invention can be used to achieve this proper cooking of many such dough products.

In addition to baking or heating of bread, structures of the present invention can be used to prepare wraps for other dough products that require very high surface heating as well as substantial bulk heating from transmitted energy. An example of such an application is the bottom of a pizza, which should be heated to the point of scorching, while the remainder of the pizza should also be well heated. A wrap of the present invention, encompassing only the crust without enfolding and shielding the remainder of the pizza, is suitable.

EXAMPLES 1-29 AND COMPARATUVE EXAMPLES C1-C9

A coating composition of 50 weight percent aluminum flakes in a polyester composition was prepared. The aluminum flakes were Reynolds LSB-548, which have the general appearance of the flake in FIG. 1. The flakes have a thickness of about 0.2–0.3 micrometers, an average length of about 18 micrometers, and an average width of about 13 micrometers. The matrix material was a copolymer which is prepared by condensation of 1.0 mol ethylene glycol with 0.53 mol terephthalic acid and 0.47 mol azelaic acid. The polymer (15.8 parts by weight) is combined with 0.5 parts by weight erucamide and 58 parts tetrahydrofuran. After dissolution of the solids at about 55° C., 0.5 parts by weight magnesium silicate and 25 parts by weight toluene are blended in, as well as sufficient aluminum flakes to make 50 percent by weight based on dry solids. The composition was applied in a thickness sufficient to provide a dried coating of 0.10 to 0.15 mm, as indicated in Table 1, to a backing of 0.13 mm (18 mil, 30 pound) paperboard. Application of the coating was made by using a doctor knife and passing the paperboard under the knife at 1.8 m (6 feet) per minute in a single pass. The coating extended over the central portion of the paperboard. No overcoat layer was used.

Some of the structures thus prepared were subjected to pressure (Examples 1-29), while other structures (Comparative Examples C1-C9) were not pressed. Pressure was applied by using a Carver TM press with platens heated to 190 C. Pressure was maintained for 120 seconds.

The microwave transmission, reflection, and absorbance, and the heat generating properties of most of the samples thus prepared were measured. Microwave transmission data was obtained in a simulated electromagnetic test. A sample of the material was measured in a coaxial cell, model SET-19, from Elgal Industries, Ltd., Israel, which was excited by 2.4 to 2.5 GHz signals from a Hewlett Packard HP8620C sweep Oscillator. This cell provides a transverse electromagnetic wave closely simulating free space microwave propagation conditions. A Hewlett Packard HP8755C scalar network analyzer was used to obtain the scattering matrix parameters of the sample under test.

Heat flux was determined by measuring the temperature rise of a sample of oil. The oil, 5 g of microwave transparent oil (Dow-Corning 210H heat transfer silicon oil), is placed in a Pyrex TM borosilicate glass tube, 125 mm long, 15 mm outside diameter. A sample of film to be tested, 46×20 mm, is wrapped around the tube, with the long dimension of the film along the length of the tube and the top edge of the film located at the level of the surface of the oil. The film sample is secured by use of microwave transparent tape prepared from polytetrafluoroethylene resin, about 6 mm larger than the film sample, and the tube assembly is supported in a holder of polytetrafluoroethylene. The temperature rise of the oil upon heating the assembly in a microwave oven is measured at 15 second intervals using a "Luxtron" temperature probe placed in the oil sample and connected to suitable recording instrumentation. Maximum heat flux is taken from the plot of oil temperature versus time, and is reported as the slope of a straight line between the 15-second measurements which gave the maximum slope.

The results of these measurements are shown in Table I. The percent transmission for samples with thicker coatings is less than that of corresponding samples with thinner coatings, as would be expected. The surprising feature, however, is that the percent transmission of the film samples is inversely dependent on the amount of pressure applied during the manufacturing process. Unpressed films exhibit microwave transmission in the range of about 60 to about 85%, the range of these values resulting from experimental uncertainties in the preparation of the individual films and in the measurement process. Application of pressure reduces the transmission to as low as 12%, in Examples 28 and 29. Such levels of transmission are so low that the samples may be said to be essentially microwave shielding materials.

The effect of pressure on the heat flux properties of the samples is also observed. Although the data shows scatter, the application of pressure tends to increase the heat generated from the samples themselves.

TABLE I[a]

| Ex. | Coating, mm | Press, MPa | % T | % R | % A | Max Flux[b] |
|---|---|---|---|---|---|---|
| C1 | 0.10 | 0 | 85.5 | 7.7 | 6.8 | 35.2 |
| C2 | " | 0 | 79.6 | 9.7 | 10.7 | 22.5 |
| C3 | " | 0 | 68.2 | 16.7 | 15.1 | 31.0 |
| C4 | " | 0 | — | — | — | 25.1 |
| 1 | " | 1.4 | 66.5 | 21.7 | 11.8 | 24.0 |
| 2 | " | 2.8 | — | — | — | 37.2 |
| 3 | " | 2.8 | 66.5 | 21.4 | 12.0 | 52.7 |
| 4 | " | 2.8 | 52.5 | 36.4 | 11.0 | 77.0 |
| 5 | " | 2.8 | — | — | — | 98.7 |
| 6 | " | 4.1 | 57.0 | 30.2 | 12.8 | 29.5 |
| 7 | " | 5.5 | 46.5 | 47.4 | 6.1 | 101.2 |
| 8 | " | 5.5 | 33.2 | 52.8 | 14.0 | — |
| 9 | " | 5.5 | 24.8 | 64.2 | 11.0 | — |
| 10 | " | 6.9 | — | — | — | 110.8 |
| 11 | " | 8.3 | 22.0 | 67.2 | 10.8 | 140.4 |
| 12 | " | 8.3 | 22.9 | 65.7 | 11.4 | 181.4 |
| 13 | " | 17.2 | 13.1 | 68.2 | 18.7 | 246.8 |
| 14 | " | 17.2 | 16.0 | 60.4 | 23.6 | — |
| C5 | 0.15 | 0 | 61.4 | 10.9 | 27.7 | 39.1 |
| C6 | " | 0 | 65.0 | 23.7 | 11.3 | 30.4 |
| C7 | " | 0 | 71.3 | 17.9 | 10.8 | 81.5 |
| C8 | " | 0 | 80.2 | 12.2 | 7.7 | 30.7 |
| C9 | " | 0 | — | — | — | 50.1 |
| 15 | " | 1.4 | 55.6 | 32.1 | 12.3 | 52.1 |
| 16 | " | 1.4 | 43.0 | 45.6 | 11.4 | 103.9 |
| 17 | " | 2.8 | 32.1 | 54.5 | 13.5 | 89.3 |
| 18 | " | 2.8 | 32.4 | 56.2 | 11.3 | — |
| 19 | " | 2.8 | 31.3 | 56.6 | 12.0 | — |
| 20 | " | 2.8 | 35.6 | 50.0 | 14.4 | 132.1 |
| 21 | " | 2.8 | 28.8 | 59.3 | 11.9 | 106.5 |
| 22 | " | 4.1 | 28.9 | 55.7 | 15.4 | 71.8 |
| 23 | " | 4.1 | 21.8 | 66.5 | 11.7 | 140.3 |
| 24 | " | 5.5 | 23.7 | 65.3 | 11.0 | 150.0 |
| 25 | " | 5.5 | 26.6[c] | 62.7 | 10.7 | — |
| 26 | " | 8.3 | 21.0 | 65.9 | 13.1 | 198.7 |
| 27 | " | 8.3 | 19.8 | 63.2 | 17.0 | 220.6 |
| 28 | " | 17.2 | 12.7 | 72.3 | 15.0 | 248.0 |
| 29 | " | 17.2 | 11.7 | 77.3 | 11.0 | — |

[a]A hyphen (-) indicates measurement not made. % T, % R, and % A are the microwave transmission, reflectance, and absorption of the film.
[b]In units of kcal/m$^2$-min.
[c]One duplicate has been excluded because of experimental problems. The apparent % T was 44.4. Likewise one run at 6.9 MPa, having an apparent % T of 43.1 has been excluded because of experimental problems.

COMPARATIVE EXAMPLES C10–C21

Comparative Examples C10–C21 were prepared as described above, except that a different form of aluminum flake was used. The flake used for these examples was Sparkle Silver TM S3641 or S3644, from Silberline Manufacturing Company, and was present at a level of 50% by weight in the coating. These flakes are illustrated in FIGS. 4 and 5, respectively. The flakes are about 0.3 to about 3 micrometers thick and about 8 to about 50 or more micrometers in transverse dimension. These flakes exhibit basically smooth, rounded edges without significant angularity on a scale greater than that of the thickness. The results in Table II indicate that samples prepared using flakes of this geometry do not exhibit significantly reduced microwave transmission upon application of pressure.

TABLE II

| Ex. | Flake type | Coating thick., mm | Press., MPa | % T | % R | % A |
|---|---|---|---|---|---|---|
| C10 | S3641 | 0.10 | 0 | 85.3 | 0.5 | 14.2 |
| C11 | S3641 | " | 2.8 | 78.0 | 2.4 | 19.6 |
| C12 | S3641 | " | 5.5 | 79.4 | 3.8 | 16.7 |
| C13 | S3641 | 0.15 | 0 | 79.3 | 3.2 | 17.5 |
| C14 | S3641 | " | 2.8 | 72.1 | 8.3 | 19.6 |
| C15 | S3641 | " | 5.5 | 70.0 | 13.2 | 16.7 |
| C16 | S3644 | 0.10 | 0 | 88.5 | 0.1 | 11.4 |
| C17 | S3644 | " | 2.8 | 88.7 | 0.1 | 11.2 |
| C18 | S3644 | " | 5.5 | 91.2 | 0.2 | 8.6 |
| C19 | S3644 | 0.15 | 0 | 88.3 | 0.1 | 11.6 |
| C20 | S3644 | " | 2.8 | 88.5 | 0.1 | 11.4 |
| C21 | S3644 | " | 5.5 | 91.0 | 0.1 | 8.0 |

EXAMPLES 30–32

Aluminum flakes shown in FIG. 2, having a thickness of about 0.1 micrometers and a transverse dimension of about 15–25 micrometers were applied to 25 micrometer PET film by the process described above. The thickness and amount of flake in the coating is shown in Table III. The films were then hand-laminated to 0.46 mm (18 mil) paperboard so that the flake coating directly contacted the paperboard. Two samples of each coating level were prepared, one of which was pressed at 11 MPa (1,600 psi) for 2 minutes. The results in Table III show that the microwave transmission was halved. For the most heavily loaded sample, application of pressure caused a reduction in heating efficiency; for the others the heating efficiency increased dramatically.

TABLE III[a]

| Ex. | g/m$^2$ Coating Total | g/m$^2$ Coating Al | % Flake in coat | Press., MPa | % T | % R | % A | Max. Flux | Max. Temp. |
|---|---|---|---|---|---|---|---|---|---|
| 30 | 12.7 | 2.5 | 20 | 0 | 83 | 6 | 11 | 19.8 | 67.0 |
| | | | | 11 | 48 | 38 | 14 | 93.0 | 143.6 |
| 31 | 6.1 | 2.4 | 40 | 0 | 80 | 15 | 5 | 29.4 | 82.2 |
| | | | | 11 | 30 | 56 | 14 | 145.1 | 169.0 |
| 32 | 23.6 | 14.2 | 60 | 0 | 2 | 91 | 7 | 172.7 | 237.3 |
| | | | | 11 | 1 | 93 | 6 | 92.1 | 175 |

[a]Units are as defined in Table I.

EXAMPLES 33–35 AND COMPARATIVE EXAMPLE C22

Aluminum flakes shown in FIG. 1 (Reynolds), having a thickness of about 0.2–0.3 micrometers and a transverse dimension of about 20–30 micrometers were coated onto 25 micrometer PET film at 20 g/m$^2$ dry coating as described above, using two coating passes. The films were hand-laminated to 0.46 mm (18 mil) paperboard (Example 33), to Bounty TM brand microwave paper towels (Example 34), to WypAll TM brand (paper) golf towels. (Example 35) or to a (nonporous) film of PET coated with polyester copolymer as described above (Comparative Example C22) so that the flake-filled coating directly contacted the substrate. Duplicate samples of each coating level were prepared, one of which was pressed at 11 MPa (1600 psi) for 2 minutes. The results in Table IV show that the heat flux and maximum temperature increased for the samples pressed to the paperboard or paper towels, but remained unchanged or decreased slightly for the pressed sample laminated to the nonporous substrate.

TABLE IV

| Ex. | substrate | Press., MPa | Max. Flux | Max. Temp. °C. |
|---|---|---|---|---|
| 33 | paperboard | 0 | 27.6 | 78 |
| | (duplicate | 0 | 30.1 | 80 |
| | samples) | 11 | 85.2 | 132 |
| | | 11 | 124.9 | 156 |
| 34 | Bounty TM | 0 | 26.4 | 77.4 |
| | towels | 11 | 55.2 | 115.7 |
| 35 | WypAll TM | 0 | 23.1 | 71.2 |
| | towels | 11 | 71.8 | 134.6 |
| C22 | PET | 0 | 20.5 | 68.1 |
| | | 11 | 16.6 | 57.5 |

Comparable samples using only a single pass of coating and 10 g/m$^2$ total coating weight exhibit the same trend but to a lesser degree.

EXAMPLES 36–41

Paper laminates were prepared with coatings of aluminum flake, as indicated in Table V. In each case aluminum flake from Reynolds in polyester copolymer matrix Was applied to 0.13 mm (18 mil, 30 lb.) paper or to 0.023 mm (92 gauge) PET in one, two, or three passes, as indicated. One pass provided a coating thickness of approximately 10 g/m$^2$, two passes approximately 20 g/m$^2$, and three passes approximately 30 g/m$^2$. The flake-coated paper or PET was then laminated to an uncoated piece of paperboard ("PB") or a paper golf towel ("GT") (examples 36–38) or to another piece of flake coated paper (examples 39 and 40). In each case the flake coating layer was situated between the outer layers of paper or PET. Lamination and pressing was accomplished using a 20 cm×20 cm (8 inch square) press to apply 6.9 MPa (1000 psi) to a 15 cm×15 cm (6 inch square) sample at 180°–190° C. for 2 minutes. The pressed samples were cooled under load to about 50° C., then removed from the press. Microwave transmission, reflectance, and absorption measurements were made on the single sheets, before lamination, as well as the composite structures before and after heat and pressure were applied. Heat flux was measured on the single sheets and the laminates. The results are shown in Table V, and indicate that the pressed laminate of Example 39 exhibits an outstanding combination of high heat flux and low transmission. Thus it is seen that it may be desirable to provide two porous substrates, one on each side of and in contact with the coating. Furthermore, multiple layers of the coating can be used in conjunction with multiple layers of substrate in order to increase shielding and heating properties. Such structures can be laminated together face-to-face as in Example 39, or one or more layers of substrate can be placed between the coating layers. A large number of such combinations are included within the scope of the present invention.

TABLE V

| Ex. | Structure | Press. | % T | % R | % A | Max. Heat Flux |
|---|---|---|---|---|---|---|
| 36 | Paper, 2 pass | 0 | 75.5 | 9.0 | 15.5 | 30.7 |
| | Paper, 2 pass plus paperboard | 0 | 72.4 | 10.3 | 17.3 | — |
| | Paper, 2 pass + PB + pressure | 6.9 | 49.4 | 23.5 | 27.1 | — |
| | Paper, 2 pass + GT + pressure | 6.9 | — | — | — | 100 |
| | Paper, 2 pass + GT + pressure | 6.9 | — | — | — | 142 |
| 37 | Paper, 3 pass | 0 | 64.6 | 15.7 | 19.7 | 51 |

TABLE V-continued

| Ex. | Structure | Press. | % T | % R | % A | Max. Heat Flux |
|---|---|---|---|---|---|---|
| | Paper, 3 pass plus paperboard | 0 | 62.5 | 17.7 | 19.8 | — |
| | Paper, 3 pass + PB + pressure | 6.9 | 28.1 | 39.2 | 32.7 | 122 |
| | Paper, 3 pass + GT + pressure | 6.9 | 26.3 | 40.5 | 33.2 | 165 |
| 38 | PET, 3 pass | 0 | 60.3 | 18.3 | 21.5 | 72 |
| | PET, 3 pass plus paperboard | 0 | 58.5 | 19.7 | 21.8 | — |
| | PET, 3 pass + PB + pressure | 6.9 | 29.5 | 38.5 | 32.0 | 80 |
| 39 | Paper, 2 pass, plus | 0 | 64.6 | 16.5 | 18.9 | 88 |
| | paper, 2 pass same plus pressure | 6.9 | 17.7 | 46.9 | 13.2 | 374 |
| 40 | Paper, 2 pass, plus paper, 1 pass, plus pressure | 6.9 | 28.9 | 56.2 | 14.9 | 166 |
| 41 | Paper, 1 pass, plus paper, 1 pass, plus pressure | 6.9 | — | — | — | 108 |

EXAMPLES 42–46

Samples were prepared from the same coated stock described in Examples 36–41 and prepared as above except that the pressing was performed using a 38 cm×38 cm (15 inch square) press, upon samples 27 cm×30 cm (10.5×12 inches). The samples were protected from the plattens of the press by a thin layer of aluminum foil (Examples 42 and 43) or polytetrafluoroethylene (Example 44–46). Heat flux test were run on the resulting structures. Several replications of the tests were run (not necessarily in the order indicated) as shown in Table VI, which reports the maximum heat flux, as above, and the temperature rise of the test apparatus above ambient temperature in C°.

TABLE VI

| Ex. | Structure | Temperature Rise | Max. Heat Flux |
|---|---|---|---|
| 42 | Paper, 3 pass + GT + pressure | 145 | 169 |
| | | 152 | 186 |
| | | 168 | 213 |
| | | 174 | 215 |
| | | 173 | 240 |
| | | 181 | 321 |
| 43 | Paper, 2 pass + paper, 1 pass + pressure | 101 | 70 |
| | | 135 | 106 |
| | | 157 | 195 |
| | | 161 | 192 |
| | | 167 | 206 |
| | | 167 | 197 |
| 44 | Paper, 2 pass + GT + pressure | 145 | 180 |
| | | 167 | 219 |
| 45 | Paper, 1 pass + paper, 1 pass + pressure | 101 | 82 |
| 46 | Paper, 3 pass + PB | 126 | 116 |
| | | 129 | 126 |
| | | 133 | 133 |
| | | 153 | 181 |
| | | 155 | 158 |
| | | 164 | 208 |

EXAMPLE 47

The sixth sample of Example 43 was tested again, after having been once subjected to the heating conditions of the first test. The temperature rise was 148° and the maximum heat flux was 166 kcal/m$^2$-min. The sixth sample of Example 46, tested again, exhibited temperature rise of 129° C. and maximum heat flux of 112 kcal/m$^2$-min. These results indicate relatively little deterioration in performance upon reuse.

EXAMPLES 48–49 AND COMPARATIVE EXAMPLES C23 AND C24

Certain of the materials from Table VI as well as controls were used to heat Pepperidge Farm French Rolls, which are fully browned and cooked rolls, rectangular in shape, 7.7 cm×6.1 cm×4.2 cm, weighing about 38 g each. A piece of susceptor material about 14 cm×22 cm was wrapped around a roll and was taped with a 2.5 cm piece of polyimide tape at a butt seal. The ends of the package were taped shut with additional polyimide tape. The roll was placed in a microwave oven with the first seal facing down. Each roll package was cooked for 1 minute at full power in a 700 W microwave oven on an inverted paper plate. In each case the roll was initially hot after the cooking time. The texture of the rolls after standing for 5 minutes is reported in Table VII.

TABLE VII

| Ex. | Structure | Texture |
|---|---|---|
| 48 | film of Ex. 42 | soft |
| 49 | film of Ex. 43 | soft |
| 50 | film of Ex. 44 | hard |
| C23 | no wrap - control | hard |
| C24 | SS on PET[a] | hard |

[a]Vacuum deposited stainless steel, 350 ohm/square resistivity, on PET between layers of PET, then laminated to parchment using acid copolymer adhesive.

EXAMPLES 51–54 AND COMPARATIVE EXAMPLE C25

Club Rolls from Pepperidge Farm, which are partially cooked "brown and serve" rolls having approximate dimensions of 11.4 cm×5.0 cm×3.5 cm and approximate weight of 38 g were selected. The rolls were wrapped in a package similar to those described in Examples 48 to 50. The partially cooked rolls show no surface browning prior to cooking. Sample rolls were cooked as in the previous examples in the wrappers indicated in Table VIII, with the results as indicated:

TABLE VIII

| Ex. | Structure | Texture[a] | Browning |
|---|---|---|---|
| 51[b] | Example 48, reused | 3 | "some" |
| 52 | Example 49, reused | 2 | "little" |
| 53 | Example 42 | 1 | "some" |
| 54 | Example 43 | 2 | "some" |
| 55 | no wrap - control | 4 | "some" |

[a]On a scale of 1 (soft) to 4 (very hard).
[b]Heated for 50 seconds.

EXAMPLE 56 AND COMPARATIVE EXAMPLE C25

Kellogg's TM strawberry filled "Pop Tarts" TM were cooked for 1 minute in wrappers of the present invention (pressed) and comparable unpressed wrappers. The Pop Tarts are pastries about 10 cm×8 cm×1 cm. The wrappers were about 11 cm×17 cm and were prepared by laminating together two layers of coated bleached Kraft paper, face to face. One layer of paper had a coating weight of 20 g/m$^2$ (10 g/m$^2$ aluminum, Reynolds) applied in two passes, and the other layer had a coating weight of 30 g/m$^2$ (15 g/m$^2$ aluminum) applied in three passes. One sample was pressed at 190° C. for 2 minutes at 6.9 MPa, while another sample was unpressed. The pressed composite was measured to have about 17% microwave transmission, while the unpressed composite had about 56% transmission. Each sample was wrapped tightly around the pastry and held in place by polyimide tape at the middle bottom of the package. A Luxtron TM temperature probe was inserted into the middle of the fruit layer of the pastry through one of the exposed ends, and the temperature rise in a 500 watt microwave oven was recorded (duplicate runs). The results are shown in Table IX.

TABLE IX

| Time, sec | Temp. °C. | Ex. 56 | | C25 | |
|---|---|---|---|---|---|
| 0 | | 17.7 | 9.4 | 13.7 | 16.1 |
| 5 | | 22.1 | 17.6 | 23.9 | 24.1 |
| 10 | | 24.2 | 20.2 | 35.1 | 36.4 |
| 15 | | 26.6 | 23.2 | 47.9 | 49.4 |
| 20 | | 29.4 | 27.2 | 60.8 | 63.6 |
| 25 | | 32.6 | 31.4 | 72.7 | 77.2 |
| 30 | | 36.9 | 36.8 | 83.3 | 90.5 |
| 35 | | 36.9 | 36.8 | 92.4 | 101.7 |
| 40 | | 46.8 | 49.3 | 98.7 | 108.6 |
| 45 | | 51.8 | 56.1 | 102.3 | 113.1 |
| 50 | | 56.8 | 61.7 | 106.7 | 117.1 |
| 55 | | 61.7 | 67.7 | 110.1 | 120.5 |
| 60 | | 66.2 | 72.3 | 112.8 | 123.8 |

EXAMPLE 57

A Kellogg's strawberry "Pop Tart" was cooked for 1 minute in a reused piece of wrapper from Example 50. The "Pop Tart" was very well browned.

EXAMPLE 58

A frozen pizza from Pillsbury, about 19 cm in diameter, was placed on a piece of composite material from Example 50 (reused), about 18×19 cm, which was taped to the empty pizza box. The pizza was cooked in a 700 W microwave oven for five minutes at full power. The pizza was done well. The heating film showed no degradation after cooking except for some scorching where the pizza did not cover the film and for some dripped cheese and filling which stuck to the board.

We claim:

1. A composite material for generation of heat by absorption of microwave energy comprising:

(a) at least one porous dielectric substrate substantially transparent to microwave energy;

(b) at least one coating on at least a portion of the substrate, comprising:

(i) a thermoplastic dielectric matrix; and (ii) flakes of a microwave susceptive material distributed within the matrix, said flakes having on average an aspect ratio of at least about 10, a generally planar, plate-like shape, with a thickness of about 0.1 to about 1.0 micrometers, a transverse dimension of about 1 to about 50 micrometers, and a predominantly jagged perimeter, said flakes being present in a concentration sufficient to heat food products in proximity thereto upon exposure to radiation of a microwave oven;

said composite material being capable of exhibiting decreased microwave transmission as a function of previously applied pressure.

2. The composite material of claim 1 wherein at least two porous dielectric substrates are present, one contacting each side of said coating.

3. The composite material of claim 1 wherein a plurality of said coatings are present, each coating contacting at least one porous dielectric substrate.

4. The composite material of claim 1 wherein the porous dielectric substrate is paper, paperboard, paper towel material, or cloth.

5. The composite material of claim 1 wherein the flakes are aluminum, nickel, antimony, copper, molybdenum, iron, chromium, tin, zinc, silver, gold, or an alloy of one or more said metals.

6. The composite material of claim 5 wherein the, flakes are aluminum.

7. The composite material of claim 6 wherein the flakes comprise about 5 to about 80 percent by weight of the microwave absorptive coating.

8. The composite material of claim 7 wherein the flakes comprise about 25 to about 80 percent by weight, of the microwave absorptive coating.

9. The composite material of claim 8 wherein the flakes comprise about 30 to about 60 percent by weight of the microwave absorptive coating.

10. The composite material of claim 6 wherein the surface concentration of the flakes is about 1 to about 50 $g/m^2$.

11. The composite material of claim 6 wherein the surface concentration of the flakes is about 2 to about 25 $g/m^2$.

12. The composite material of claim 1 wherein the flakes have on average an aspect ratio of at least about 40, a thickness of about 0.1 to about 0.5 micrometers, and a transverse dimension of about 4 to about 30 micrometers.

13. The composite material of claim 1 wherein the matrix is a polyester selected from the group consisting of copolymers of ethylene glycol, terephthalic acid, and azelaic acid; copolymers of ethylene glycol, terephthalic acid and isophthalic acid; and mixtures of said copolymers.

14. The composite material of claim 13 wherein the matrix is a copolymer prepared by the condensation of ethylene glycol with terephthalic acid and azelaic acid, said acids being in the mole ratio of about 50:50 to about 55:45.

15. The composite material of claim 1 wherein the coating thickness is about 0.01 to about 0.25 mm.

16. The composite material of claim 1 further comprising a layer of a heat sealable material extending over at least a portion of the surface of the composite material.

17. The composite material of claim 1 further comprising a layer of heat resistant plastic film.

18. A process for manufacturing a composite material suitable for generation of heat by absorption of microwave energy comprising:

(a) providing at least one porous dielectric substrate substantially transparent to microwave radiation;

(b) applying to the substrate at least one coating of a thermoplastic dielectric matrix with a dispersion of flakes of a microwave susceptive material distributed therein, said flakes having on average an aspect ratio of at least about 10, a generally planar, plate-like shape, with a thickness of about 0.1 to about 1.0 micrometers, a transverse dimension of about 1 to about 50 micrometers, and a predominantly jagged perimeter, said flakes being present in a concentration sufficient to heat food products in proximity thereto upon exposure to radiation of a microwave oven;

(c) heating the coating to a temperature above the softening point of the matrix; and (d) pressing at least a portion of the heated coating against the substrate at a pressure of at least about 0.3 MPa for at least about 0.03 seconds, whereby the transmission of microwave energy through the portion of the coating so pressed is thereafter reduced.

19. The process of claim 18 wherein at least two porous dielectric substrates are provided, one contacting each side of said coating.

20. The process of claim 18 wherein a plurality of said coatings are applied, each coating contacting at least one porous dielectric substrate.

21. The process of claim 18 wherein the coating of a dispersion of flakes in a thermoplastic matrix is applied in a plurality of passes.

22. The process of claim 18 wherein the pressure is applied for about 1 to about 200 seconds.

23. The process of claim 18 wherein the pressure is about 0.7 to about 17 MPa.

24. The process of claim 18 wherein the pressure is about 1.4 to about 12 MPa.

25. The process of claim 18 wherein differing pressure is applied to differing areas of the composite material, whereby the differing areas exhibit differing levels of reflectivity of microwave energy.

26. A bag suitable for preparing popcorn, sealed together at its seams with a sealant, said bag formed from a composite material for generation of heat by absorption of microwave energy comprising:

(a) at least one porous dielectric substrate substantially transparent to microwave energy;

(b) at least one coating on at least a portion of the substrate, comprising:

(i) a thermoplastic dielectric matrix; and (ii) flakes of a microwave susceptive material distributed within the matrix, said flakes having on average an aspect ration of at least about 10, a generally planar, plate-like shape, with a thickness of about 0.1 to about 1.0 micrometers, a transverse dimension of about 1 to about 50 micrometers, and a predominantly jagged perimeter, said flakes being present in a concentration sufficient to heat fool products in proximity thereto upon exposure to radiation of a microwave oven;

said composite material being capable of exhibiting decreased microwave transmission as a function of previously applied pressure, wherein the portion of the composite material which forms the bottom of the bag has been subjected to sufficient pressure to provide a region of sufficient heating in a microwave oven to pop corn, and wherein the concentration of flakes in the composite material is sufficiently low that in the unpressed areas the heat generated is insufficient to cause the sealant to melt.

27. A composite material suitable for generation of heat by absorption of microwave energy prepared by the process comprising:

(a) providing at least one porous dielectric substrate substantially transparent to microwave radiation;

(b) applying to the substrate at least one coating of a thermoplastic dielectric matrix with a dispersion of flakes of a microwave susceptive material distributed therein, said flakes having on average an aspect ration of at least about 10, a generally planar, plate-like shape, with a thickness of about 0.1 to about 1.0 micrometers, a transverse dimension of about 1 to about 50 micrometers, and a predominantly jagged perimeter, said flakes being present in a concentration sufficient to heat food products in proximity thereto upon exposure to radiation of a microwave oven;

(c) heating the coating to a temperature above the softening point of the matrix; and (d) pressing at least a portion of the heated coating against the substrate at a pressure of at least about 0.3 MPa for at least about 0.03 seconds, whereby the transmission of microwave energy through the portion of the coating so pressed is thereafter reduced.

28. The composite material of claim 27 wherein at least two porous dielectric substrates are provided, one contacting each side of said coating.

29. The composite material of claim 27 wherein differing pressure is applied to differing areas of the composite material, whereby the differing areas exhibit differing levels of reflectivity of microwave energy.

30. A package comprising a composite material suitable for generation of heat by absorption of microwave energy, said composite material being wrapped about a food item and being prepared by the process comprising:

(a) providing at least one porous dielectric substrate substantially transparent to microwave radiation;

(b) applying to the substrate at least one coating of a thermoplastic dielectric matrix with a dispersion of flakes of a microwave susceptive material distributed therein, said flakes having on average an aspect ration of at least about 10, a generally planar, plate-like shape, with a thickness of about 0.1 to about 1.0 micrometers, a transverse dimension of about 1 to about 50 micrometers, and a predominantly jagged perimeter, said flakes being present in a concentration sufficient to heat food products in proximity thereto upon exposure to radiation of a microwave oven;

(c) heating the coating to a temperature above the softening point of the matrix; and (d) pressing at least a portion of the heated coating against the substrate at a pressure of at least about 0.3 MPa for at least about 0.03 seconds, whereby the transmission of microwave energy through the portion of the coating so pressed is thereafter reduced.

31. The package of claim 29 wherein the food item is a dough product.

* * * * *

UNITED STATES PATENT AND TRADEMARK OFFICE

CERTIFICATE OF CORRECTION

PATENT NO. : 4, 972,058

DATED : November 20, 1990

INVENTOR(S) : Benson et al.

It is certified that error appears in the above—identified patent and that said Letters Patent is hereby corrected as shown below:

In claim 26, at column 16, line 39, change the word "ration" to read --ratio--.

In claim 26, at column 16, line 45, change the word "fool" to read --food--.

In claim 27, at column 16, line 67, change the word "ration" to read --ratio--.

Signed and Sealed this

Thirtieth Day of April, 1991

*Attest:*

*Attesting Officer*

HARRY F. MANBECK, JR.

*Commissioner of Patents and Trademarks*